United States Patent [19]

McCracken et al.

[11] Patent Number: 4,580,334

[45] Date of Patent: Apr. 8, 1986

[54] METHOD FOR MANUFACTURING A COMMUTATOR

[75] Inventors: William T. McCracken, Flint, Mich.; Richard S. McClaughry, El Cerrito, Calif.; Charles H. Berry, III, Grand Blanc, Mich.

[73] Assignee: General Motors Corporation, Detroit, Mich.

[21] Appl. No.: 730,951

[22] Filed: May 6, 1985

[51] Int. Cl.[4] ..... H01R 43/06

[52] U.S. Cl. ..... 29/597; 310/233; 219/121 LC

[58] Field of Search ..... 29/597, 596, 598; 219/121 LC; 123/506; 310/231, 233

[56] References Cited

U.S. PATENT DOCUMENTS

| | | | |
|---|---|---|---|
| 2,758,229 | 8/1956 | Perry | 310/231 |
| 3,418,991 | 12/1968 | Shultz et al. | 123/179 |
| 4,283,841 | 8/1981 | Kamiyama | 27/597 |
| 4,326,118 | 4/1982 | Smith | 219/121 LC |
| 4,383,164 | 5/1983 | Eto | 219/121 LC |
| 4,399,383 | 8/1983 | Kamiyama | 310/87 |
| 4,446,352 | 5/1984 | O'Cheskey et al. | 219/121 LC |

*Primary Examiner*—Howard N. Goldberg
*Assistant Examiner*—Leonard S. Selman
*Attorney, Agent, or Firm*—Robert M. Sigler

[57] ABSTRACT

A disk armature for an electric, in-tank fuel pump motor is manufactured by laser welding a pair of annular disks in two concentric circles of spot welds, one near each of the inner and outer circumferences of the disks. One disk is made of malleable copper for the forming of commutator hooks and studs; the other is made of hardened copper alumina for superior wear characteristics in a sour gasoline environment. The welded disks are affixed to an insulating support and cut into segments, each having at least one weld from the inner circle and two from the outer circle. Thus the segments are each securely welded without deformation or degredation of the superior wear properties of the copper alumina disk.

1 Claim, 3 Drawing Figures

METHOD FOR MANUFACTURING A COMMUTATOR

SUMMARY OF THE INVENTION

This invention relates to the manufacture of a disk commutator for the motor of an electric, in-tank fuel pump for a motor vehicle. Such a commutator should exhibit good wear characteristics, since its location makes it difficult to replace. However, hydroperoxides in sour gasoline, occasionally found in motor vehicle fuel tanks, promote rapid wear of the malleable copper usually used for commutator segments. The malleable copper is desired, however, for the formation of commutator tabs for the attachment of armature windings and of anchoring studs to help hold the segments on a molded insulating support.

A proposed solution is the creation of a disk commutator from two disks welded together back-to-back, attached to the insulating support and cut into segments. One disk is made of malleable copper for easy formation of hooks or studs; and the other disk is made of a substance having superior wear properties in a sour gasoline environment. The U.S. Pat. No. 4,283,841 issued to Kamiyama on Aug. 18, 1981 describes a commutator manufacturing method wherein the other disk is a sheet of silver or silver alloy and attached by pressure welding. However, the Kamiyama disclosure is not concerned with a sour gasoline environment; and its silver or silver alloy does not exhibit the desired superior wear desired in such an environment.

It has been discovered that a form of copper alumina has superior wear properties in a sour gasoline environment. However, it is not ideally suited for the pressure welding process described in Kamiyama, since the pressure will subject the copper alumina to possible deformation or breakage and may work harden it to a greater degree of hardness than desired, with resultant degredation of the superior wear properties. In addition, the pressure welding process, when applied to disks, may weld the uncut disks across an unpredictable and unknown portion of their surfaces. When the disks are cut into commutator segments, one or more of the segments may be inadequately welded, with consequent poor conduction or possible total separation.

SUMMARY OF THE INVENTION

Therefore, it is an object of this invention to provide a method of manufacturing a disk commutator for a vehicle fuel pump driving motor in a sour gasoline environment in which a disk of malleable copper and a disk of copper alumina are securely joined without deformation, breakage or degradation of the copper alumina disk or of the superior wear properties of the same and with assurance that, when the disks are cut into separate commutator segments, each will be securely and accurately welded.

This and other objects are achieved in a method for manufacturing a disk commutator for a vehicle fuel pump driving motor to be operated in a sour gasoline environment comprising the steps of holding an annular disk of malleable copper against a matching annular disk of copper alumina, the matching annular disk having superior brush wear properties in a sour gasoline environment but being subject to possible deformation or degredation of these properties if subjected to excessive pressure, laser welding the disks in two concentric circles of spot welds, one circle near each of the inner and outer circumferences of the disks, attaching the welded disks to an insulating support, and cutting the disks into commutator segments, each of said segments having at least one spot weld near the inner circumference and two near the outer circumference of the disks. In this way, the welding and electrical contact of each segment is assured without deformation or degredation of the superior wear qualities of the copper alumina disk.

Further details and advantages of this invention will be apparent from the accompanying drawings and following description of a preferred embodiment.

DESCRIPTION OF THE PREFERRED EMBODIMENT

Figure 2:
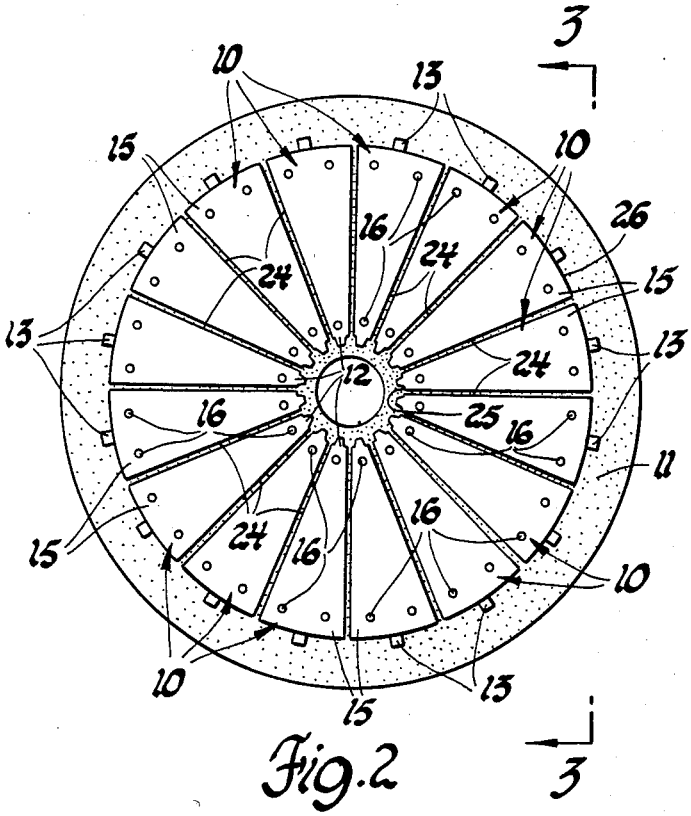
FIG. 2 shows a top view of the commutator manufactured by the method of this invention.
Figure 3:
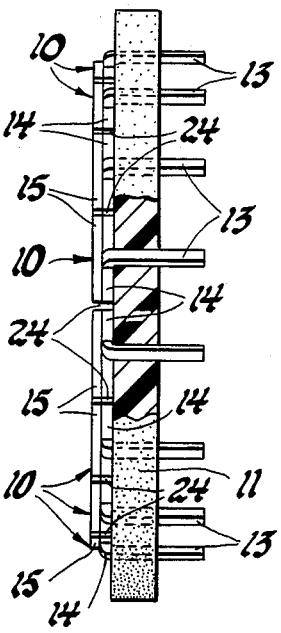
FIG. 3 shows a section view along lines 3—3 of FIG. 2.

Referring first to FIGS. 2 and 3, the finished commutator comprises a plurality of segments 10 affixed to a molded insulating support 11 by means of inner studs 12 and outer studs 13, embedded in support 11. Each segment comprises an underlayer 14 of malleable copper and an overlayer 15 of copper alumina, more specifically AL20 Glid Cop (R), from Glidden Chemical Co. The layers 14 and 15 of each segment 10 are joined by laser spot welds 16, one near the inner circumference of the commutator and two near the outer circumference thereof. There may be more than this number of welds; however, at least three are desirable for stability of the segment in the finished commutator. Commutator tabs may also be formed from layers 14 of segments 10 for the attachment of armature windings. In this embodiment they comprise the extended outer studs 13, which project through insulating support 11.

Figure 1:
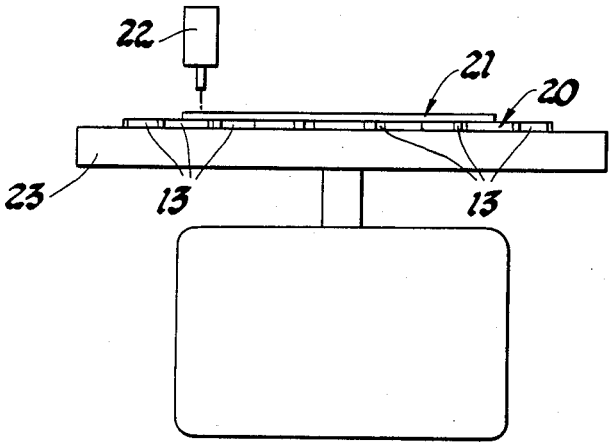
FIG. 1 shows an apparatus for laser welding two disks in the method of this invention.

The commutator is manufactured as shown in FIG. 1. A disk 20 of malleable copper and a disk 21 of copper alumina are held together in a rotatable fixture 23. Each of disks 20 and 21 is annular in shape with an inner and an outer circumference, seen more clearly in the final commutator of FIG. 2. Disk 20 also has studs 12 and 13 projecting radially inward and outward, respectively, in the plane of the disk. A laser welder 20 is actuated to produce laser spot welds 16 in a pattern as shown in FIG. 2, with a circle of such welds near the inner circumference of the disks and a circle of double the number of welds near the outer circumference. Each of the welds produces a secure attachment of the disks in a precisely confined area, leaving most of each disk unchanged and adding no new material to the commutator. The welded disks are then held in another fixture, not shown, while an insulating support is molded thereto, with the studs 12, 13 bent 90 degrees and embedded therein. The disks may then be cut radially to produce segments as seen in FIG. 2, with each pair of adjacent radial cuts 24 electrically isolating a segment defined therebetween. Each segment 10 comprises an underlayer 14 and an overlayer 15 and is held together by at least one weld 16 near the inner circumference 25 and at least two welds 16 near the outer circumference 26. The use of the laser welding process causes a portion of the materials of the two disks to intermingle in a narrow volume which extends through the copper alumina disk 21 and pierces about halfway through the malleable copper disk 20 to produce stable and dependable attachment and electrical conduction.

The embodiments of the invention in which an exclusive property or privilege is claimed are defined as follows:

1. A method for making a disk commutator for a vehicle fuel pump driving motor to be operated in a gasoline environment comprising the following steps:

holding an annular disk of malleable copper adjacent a matching annular disk of hardened copper alumina, the matching annular disk having superior wear properties in a sour gasoline environment but being subject to possible degredation of these properties if subjected to excessive pressure;

laser welding the disks in two concentric circles of spot welds, one circle near the inner circumference and one near the outer circumference of the disks;

attaching the welded disks to an insulating support; and cutting the disks into commutator segments, each of said segments having at least one spot weld near the inner circumference and at least two near the outer circumference of the disks, whereby the welding and electrical contact of each segment is assured without deformation or degredation of the aforementioned superior qualities.

* * * * *